US007762199B2

(12) United States Patent
Matysik et al.

(10) Patent No.: US 7,762,199 B2
(45) Date of Patent: Jul. 27, 2010

(54) FRAME SEAL FOR A SOLID FUEL DISTRIBUTOR

(75) Inventors: Richard M. Matysik, Sweet Valley, PA (US); James C. Nelligan, Dallas, PA (US); Todd L. Albertson, Shickshinny, PA (US); Michael J. Grochowski, Mountain Top, PA (US)

(73) Assignee: ALSTOM Technology Ltd, Baden (CH)

( * ) Notice: Subject to any disclaimer, the term of this patent is extended or adjusted under 35 U.S.C. 154(b) by 463 days.

(21) Appl. No.: 11/315,476

(22) Filed: Dec. 22, 2005

(65) Prior Publication Data

US 2007/0144411 A1 Jun. 28, 2007

(51) Int. Cl.
*F23K 3/18* (2006.01)

(52) U.S. Cl. ..... 110/115; 110/108; 110/101 R

(58) Field of Classification Search ..... 414/176, 414/147, 160, 172, 173, 174, 189, 219, 202, 414/203, 204; 110/115, 101 R, 104 R, 105, 110/112, 253, 173 R
See application file for complete search history.

(56) References Cited

U.S. PATENT DOCUMENTS 2,065,555 A * 12/1936 Beers ..... 110/115
2,100,252 A * 11/1937 Hoffman ..... 110/115
2,146,469 A * 2/1939 Foster ..... 110/108
2,654,331 A 5/1950 Mosshart
2,735,384 A 2/1956 Kohout
3,241,506 A 3/1966 Miner, Jr.
4,060,042 A 11/1977 Baraldi et al.
4,326,469 A 4/1982 Reschly
6,273,009 B1 8/2001 Magnusson

* cited by examiner

*Primary Examiner*—Kenneth B Rinehart
(74) *Attorney, Agent, or Firm*—Lawrence P. Zale

(57) ABSTRACT

A feeder assembly (28) for projecting solid fuel, such as coal (24), into a combustion chamber (11) of a furnace (10) includes a distributor (44) and a feeder (42) disposed in a housing (40). The distributor (44) includes a rotor (48) having blades (46) extending outwardly therefrom, and the rotor (48) is rotatable to project the solid fuel into the combustion chamber (11). The feeder (42) includes a conveyor assembly (50) for providing the solid fuel to the rotor (48). The housing (40) includes an aperture (41) disposed therein, through which the solid fuel is projected into the combustion chamber (11). The housing (40) also includes a portion (45) movable between: a first position wherein the aperture (41) is open to allow the solid fuel to be projected into the combustion chamber (11), and a second position wherein the movable portion (45) closes the aperture (41) to shield the rotor (48) from heat emitted from the combustion chamber (11) and allow maintenance and/or replacement of the distributor (44).

21 Claims, 7 Drawing Sheets

Open Position

Closed Position

Open Position

Open Position

Closed Position

Closed Position

FRAME SEAL FOR A SOLID FUEL DISTRIBUTOR

BACKGROUND

The invention relates to a solid fuel distributor and, more particularly, to a frame seal for a solid fuel distributor.

In certain furnaces that burn solid fuel, such as coal, a distributor projects the solid fuel into the furnace. Typically, a distributor comprises a rotating wheel (rotor) having blades extending radially outward therefrom. These blades are usually mounted in rows generally parallel to the axis of the rotor, and as the rotor rotates, the blades project the solid fuel into the furnace. Such distributors may be known as "underthrow" or "overthrow" distributors, depending on the direction of rotation of the rotor. For example, in an underthrow distributor, the rotor rotates such that the blades move the solid fuel under the rotor's axis and into the furnace. In an overthrow distributor, the rotor rotates such that the blades move the solid fuel above the rotor's axis and into the furnace.

The projection of solid fuel from one or more distributors results in a substantially uniform distribution of coal onto a stationary or moving grate (stoker) within the furnace. The stoker surface may be stationary or moving, and some or all of the air for combustion travels through the stoker. Within the furnace, fines are burned in suspension while larger particles fall and burn on the stoker.

Typically, solid fuel is provided to the distributor from by a feeder, which may include a conveyor assembly that conveys substantially uniform increments of the solid fuel from a coal silo to the distributor. The conveyor assembly drops the coal to fall in between respective pairs of the rotating blades of the distributor, and the distributor further conveys the coal to the furnace. The feeder and distributor may share a common housing, with the assembly being referred to as a feeder assembly.

While some components and sub-assemblies on the feeder assembly can be serviced with the furnace online, if the distributor is removed, the operator will be directly exposed to the combustion inside the furnace. Therefore, to perform maintenance on the distributor, the furnace must be taken offline, thus causing a loss in steam generation of the plant. Thus, there remains a need for a frame seal for performing maintenance on the distributor of the feeder assembly.

SUMMARY

The above described and other drawbacks and deficiencies of the prior art are overcome or alleviated by an apparatus for projecting solid fuel into a combustion chamber of a furnace. The apparatus comprises a housing and a rotor disposed in the housing. The rotor has blades extending outwardly therefrom, and the rotor is rotatable to project the solid fuel into the combustion chamber. The rotor housing has an aperture through which the solid fuel is projected from the rotor into the combustion chamber. The rotor housing includes a portion movable between: a first position wherein the aperture is open to allow the solid fuel to be projected into the combustion chamber, and a second position wherein the movable portion closes the aperture to shield the rotor from heat emitted from the combustion chamber.

In another aspect, there is provided a feeder assembly for projecting solid fuel into a combustion chamber of a furnace. The feeder assembly comprises a distributor and a feeder disposed in a housing, which has an aperture disposed therein through which the solid fuel is projected into the combustion chamber. The distributor includes a rotor having blades extending outwardly therefrom, and the rotor is rotatable to project the solid fuel into the combustion chamber. The feeder includes a conveyor assembly for providing the solid fuel to the rotor. The housing includes a portion movable between: a first position wherein the aperture is open to allow the solid fuel to be projected into the combustion chamber, and a second position wherein the movable portion closes the aperture to shield the rotor from heat emitted from the combustion chamber.

In yet another aspect, there is provided a method of shielding a distributor rotor from heat emitted from a combustion chamber in a furnace. The method comprises: pivoting a movable portion of a rotor housing about a rotational axis of the rotor from a first position to a second position, wherein, in the first position, an aperture in the rotor housing is open to allow the rotor to project solid fuel into the combustion chamber, and in the second position, the movable portion closes the aperture to shield the rotor from the heat emitted from the combustion chamber.

BRIEF DESCRIPTION OF THE DRAWINGS

Referring now to the drawings, wherein like items are numbered alike in the various Figures.

DETAILED DESCRIPTION

Figure 1:
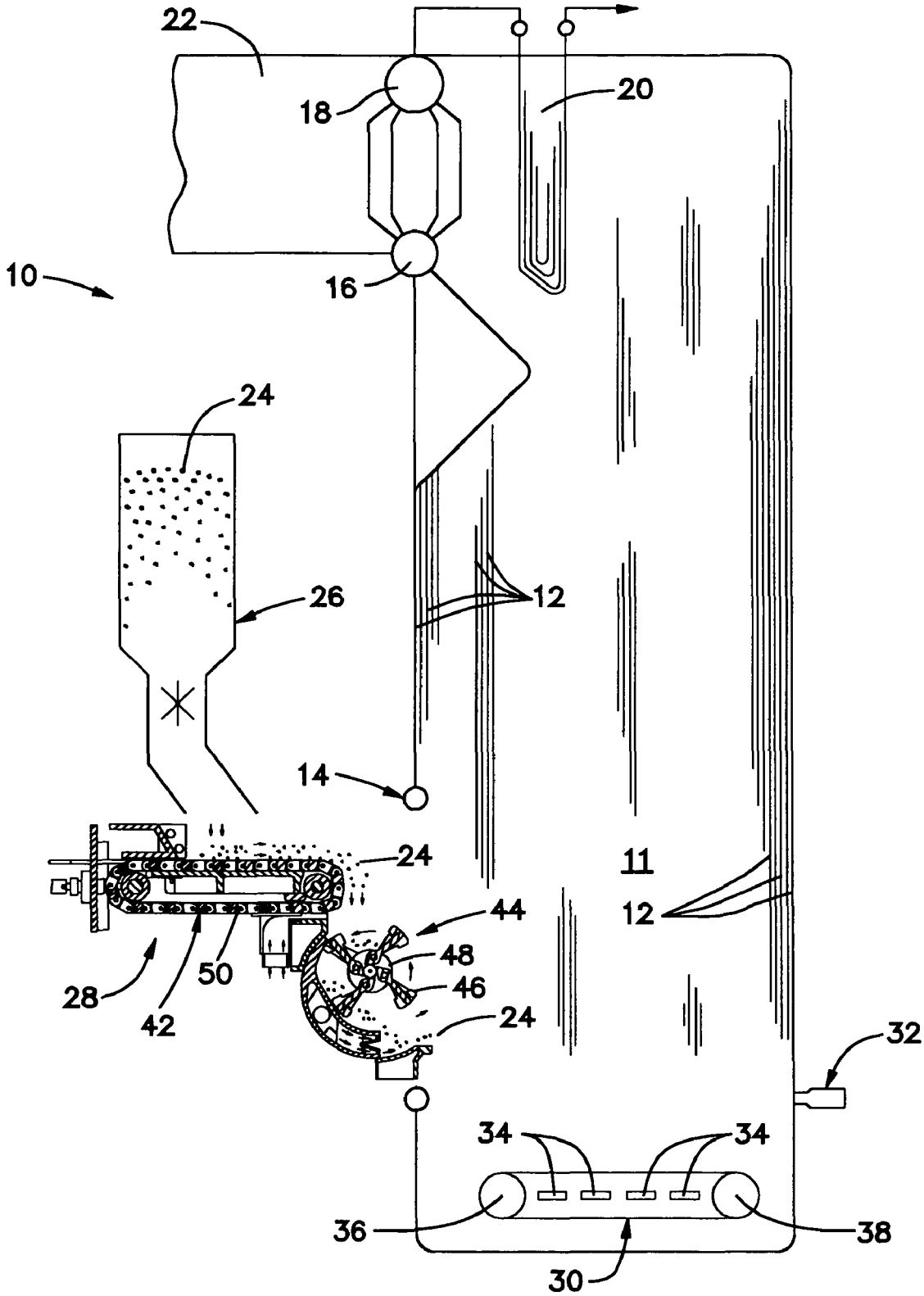
FIG. 1 is a schematic sectional elevation view of a solid fuel burning furnace including a feeder assembly.

Referring to FIG. 1, an example of a furnace 10 is shown. The furnace 10 is operable in conventional manner to combust a solid fuel (e.g., coal) within a combustion chamber 11 of the furnace 10. The furnace 10 comprises an enclosure whose walls are formed in part by tubes 12 in fluid communication with headers 14. The headers 14 receive water from a lower drum 16 through downcomers (not shown). A mixture of steam and water exits from the upper ends of tubes 12 into an upper drum 18. Flue gas generated in the furnace 10 passes in heat exchange contact with conventional heat exchange surfaces such as, for example, a superheater 20 as it flows to and along a backpass 22. The arrangement of furnace 10 is shown for example only, and it is contemplated that other furnace arrangements may be used.

Referring now more particularly to the solid fuel delivery arrangement of the furnace 10, coal 24 or other solid fuel, which may have been optionally subjected to an appropriate particle size reduction treatment such as, for example, grinding thereof by a pulverizer (not shown), is stored in a silo 26 and is fed therefrom in a metered manner into a feeder assembly 28. The feeder assembly 28 includes a feeder 42 and a distributor 44. While only one feeder assembly 28 is shown, it will be appreciated that multiple feeder assemblies 28 may be used for a single furnace 10.

The feeder 42 may include a conveyor assembly 50 that conveys substantially uniform increments of the coal 24 from the silo 26 to the distributor 44. While the feeder 42 is shown to include a conveyor assembly 50, other types of feeders may be used. For example, the feeder 42 may comprise a rotating drum or wheel, or the feeder 42 may be a simple gravity-feed arrangement.

The distributor 44 comprises a rotating wheel (rotor) 48 having blades 46 extending therefrom. The blades 46 are secured at uniform angular spacings around the rotor 48 and extend radially from the rotor 48. The blades 46 may be mounted in rows generally parallel to the axis of the rotor 48, and as the rotor 48 rotates, the blades 46 project the coal 24 into the combustion chamber 11 of the furnace 10.

In operation, coal 24 is provided from the silo 26 to the feeder 42, which drops the coal 24 to fall in between respective pairs of blades 46 of the rotating distributor 44, and the distributor 44 further conveys the coal 24 to the combustion chamber 11 of the furnace 10. The distributor 44 projects the coal 24 onto a stoker 30 located at the bottom of the combustion chamber 11. At least some of the coal 24 is combusted as it is supported on the traveling grate stoker 30 while overfire air is supplied through a plurality of nozzles 32 and underfire air is supplied beneath the stoker 30 via a plurality of underfire air inlets 34.

The stoker 30 may be a traveling gate stoker, which includes a continuous "chain" of interconnected laterally elongated bar and key assemblies trained around a stoker idler sprocket 36 and a stoker drive sprocket 38. The traveling grate stoker 30 is driven by rotation of the stoker drive sprocket 38. Alternatively, a stationary stoker 30 may be used.

Figure 2:
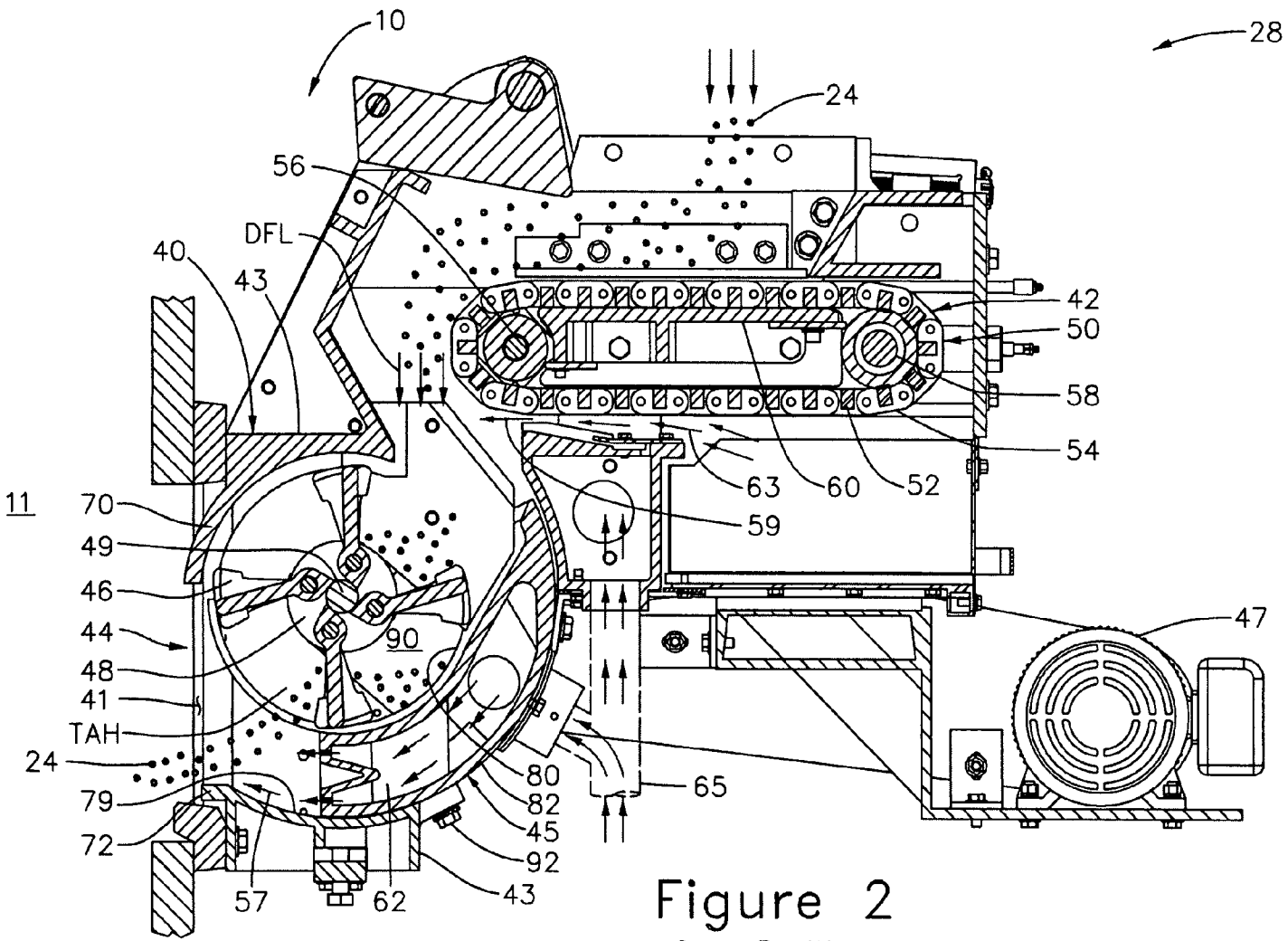
FIG. 2 is a sectional elevation view of the feeder assembly including a frame seal for performing maintenance on the distributor of the feeder assembly, the frame seal being shown in an operating position.
Figure 3:
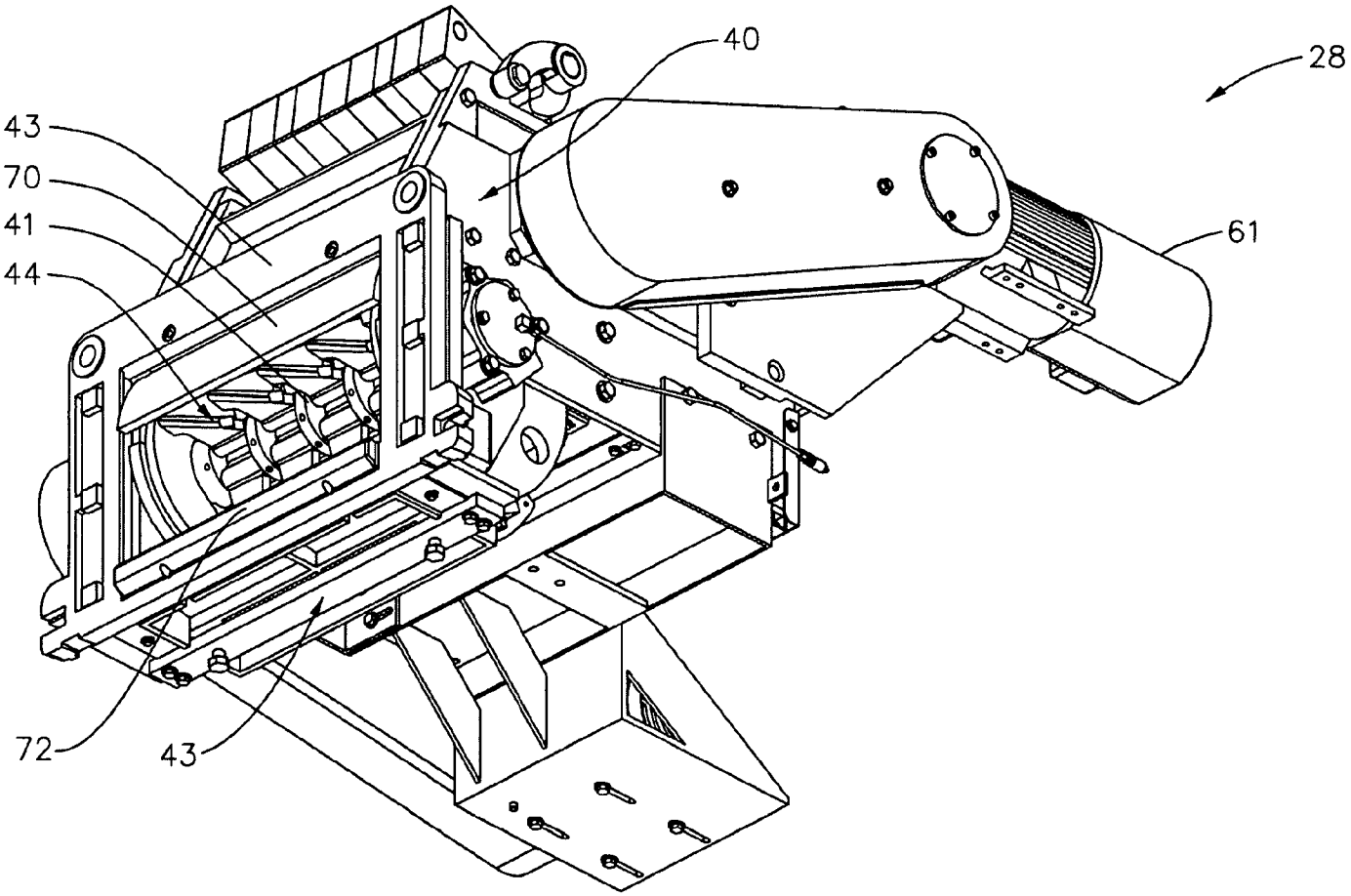
FIG. 3 is a bottom perspective view of the feeder assembly with the frame seal shown in the operating position.

FIG. 2 is a sectional elevation view of the feeder assembly 28, and FIG. 3 is a bottom perspective view of the feeder assembly 28. As previously noted, the feeder assembly 28 includes the distributor 44, which projects the coal 24 into the combustion chamber 11 of the furnace 10, and the feeder 42, which conveys coal 24 or other solid fuel to the distributor 44. The feeder 42 and distributor 28 are mounted within a housing 40, which contains the coal 24 as it passes from the silo 24 (FIG. 1.) to the combustion chamber 11. Disposed in the housing 40 is an aperture 41 through which the coal 24 is projected from the distributor 44 into the combustion chamber 11 of the furnace 10. As will be discussed in further detail hereinafter, the housing 40 includes a stationary portion 43, in which the aperture 41 is formed, and a movable portion 45, which is movable between an open position wherein the aperture 41 is open to allow the distributor 44 to project coal 24 into the combustion chamber 11, and a closed position, wherein the movable portion 45 closes the aperture 41 to shield the distributor 44 from the heat emitted from the combustion chamber 11. The movable portion 45 acts as a frame seal to shield the distributor 44 from combustion heat within the combustion chamber 11 of the furnace 10, thus allowing a technician to perform maintenance on the distributor 44 and/or replace the distributor 44 while the furnace 10 is in operation. In FIG. 2, the movable portion 45 is shown in an operating (open) position to allow the projection of coal 24 from the distributor 44 into the combustion chamber 11.

The feeder 42 is comprised of the conveyor assembly 50, which may be formed of a plurality of feeding bars 52 secured together by a plurality of links 54 in an endless loop. Each feeding bar 52 is spaced from adjacent feeding bars 52 such that the respective spaces thus formed between respective adjacent pairs of the feeding bars 52 can receive and convey coal 24. The conveyor assembly 50 moves in a loop around a conveyor drive sprocket 56 and a conveyor idler sprocket 58, each of which has an axis of rotation parallel to the distribution rotor axis 49, whereupon the conveyor assembly 50 continuously or endlessly travels successively along an upper run extending from the conveyor idler sprocket 58 to the conveyor drive sprocket 56 and a lower run extending from the conveyor drive sprocket 56 to the conveyor idler sprocket 58. The drive sprocket 56 is operatively connected (e.g., by chain drive, belt drive, direct drive, etc.) to a conventional alternating current (AC) inverter duty, synchronous motor 61 (FIG. 3) that rotates the drive sprocket 56, and thus the conveyor assembly 50 and idler sprocket 58. A support plate 60 supports the conveyor assembly 50 along its upper run.

The rotor 48 is operatively connected (e.g., by chain drive, belt drive, direct drive, etc.) to a conventional alternating current (AC) inverter duty, synchronous motor 47 that rotates the rotor 48, and the blades 46 connected thereto, about a rotor axis 49. In the embodiment shown, the blades 46 and rotor 48 of the distributor 44 rotate in a direction that is opposite to that of the conveyor assembly 50 of the feeder 42. For example, with respect to the arrangement shown in FIG. 2, the blades 46 and rotor 48 of the distributor 44 rotate in a clockwise direction while the conveyor assembly 50 of the feeder 42 rotates in a counter-clockwise direction. The feeder 42, as it travels along its upper run, thus conveys the coal 24 to a drop-off location DFL at which conveyed coal 24 drops off the feeder 42 for receipt thereof by the rotating blades 46 of the distributor 44. Specifically, the coal 24 falls from the feeder 42 at the drop off location DFL into the gaps between angularly adjacent pairs of the blades 46 and the distributor 44 then carries the coal 24 in a path from approximately the top dead center of the rotational path of the distributor 44, beneath the rotor axis 49, to a throw out location TAH at which the conveyed coal 24 is projected through the aperture in the housing and into the combustion chamber 11.

The projection of the coal 24 by the distributor 44 is assisted by one or more streams of air 57 introduced at the throw out location TAH and directed generally towards the combustion chamber 11 by way of an air outlet duct 62; these streams of air 57 promote the transport of the relatively more fine particles of the coal 24 away from the distributor 44 and into the combustion chamber 11. Another stream of air 59 may be introduced beneath the feeder 42 and directed generally towards the distributor 44 by way of a duct 63 positioned beneath the feeder 42; this stream of air 59 helps to prevent any coal particles from depositing on surfaces beneath the feeder 42. The ducts 62 and 63 are in fluid communication with a pressurized air source 65 (e.g., a fan, compressor, air plenum, or the like), which may be external to the feeder assembly 28 and which supplies the pressurized air flowing in the ducts 62 and 63.

The aperture 41 of the housing 40 is formed in the stationary portion 43 of the housing 40, and is located between an upper frame seal portion 70 of the stationary portion 43, and a lower frame seal portion 72 of the stationary portion 43. The upper and lower frame seal portions 70 and 72 are secured relative to a wall of the furnace 10.

Figure 5:
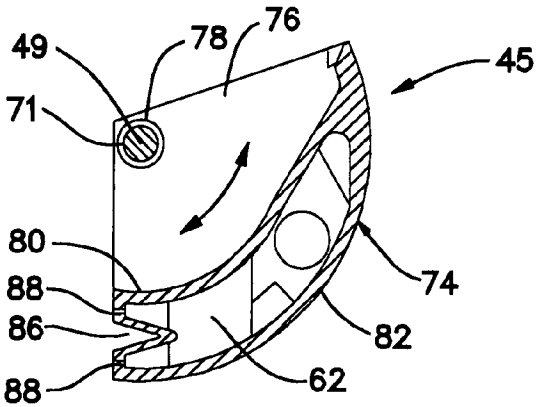
FIG. 5 is a cross-sectional, elevation view of the movable portion, as taken along 5-5 of FIG. 4.
Figure 4:
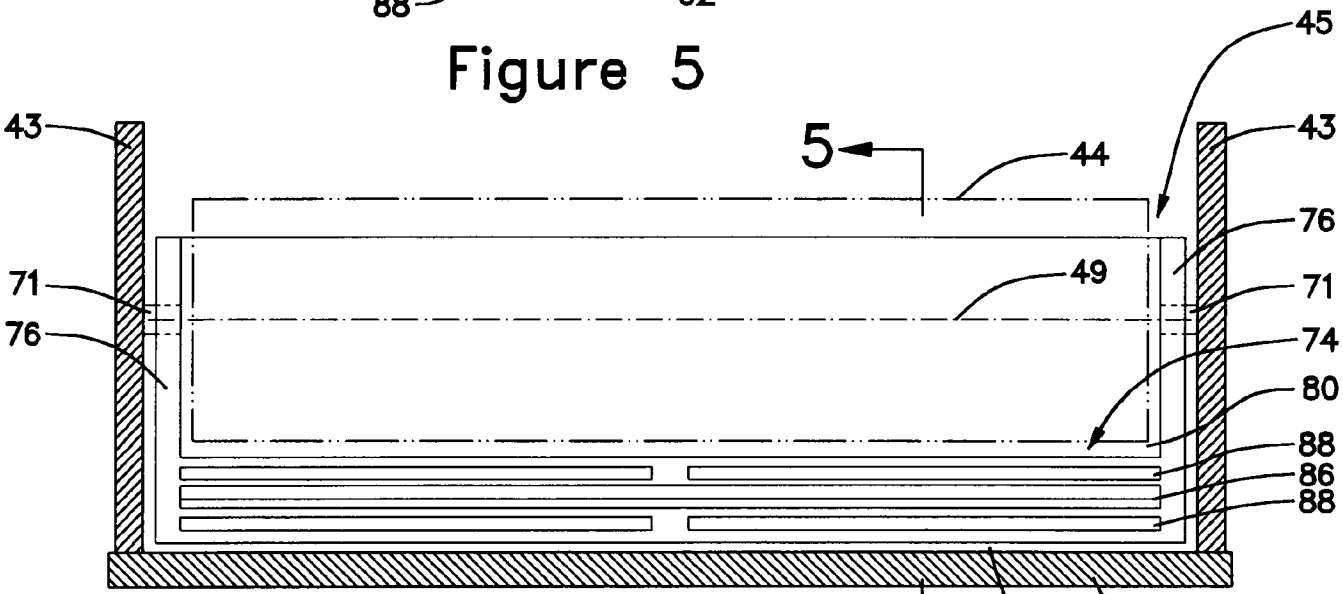
FIG. 4 is an elevation view of a movable portion of a housing of the feeder assembly which forms the frame seal of the feeder assembly.

FIG. 4 depicts an elevation view of the movable portion 45 of the housing 40, and FIG. 5 depicts a cross-sectional, elevation view of the movable portion 45, as taken along 5-5 of FIG. 4. As can be seen in FIGS. 4 and 5, the movable portion 45 has a generally arcuate portion 74, which extends lengthwise along the distributor 44 (shown in phantom), and flange portions 76 located at opposite ends of the arcuate portion 74.

The arcuate portion 74 has an inner arcuate surface 80 proximate the distributor 44, and an outer arcuate surface 82 opposite the inner surface 80. The duct 62 is disposed between the inboard and outboard surfaces, and includes a main chamber 84, which receives pressurized air from the source 65 (FIG. 2), a diverter 86, which diverts the stream of air from the chamber into two or more streams, and outlet portions 88, through which the air streams pass. The air source 65 may be connected to the movable portion 45 by way of a flexible duct, which allows for movement of the movable portion 45 without breaking connection to the air source 65. Alternatively, the air source may be connected to the movable portion 45 by way of a rigid duct, which may be removed to allow movement of the movable portion 45. The movable portion 45 may be formed from a metal or other rigid material.

The flange portions 76 are positioned outboard of the distributor 44, and include an aperture, bearing surface or other device 78 that allows the movable portion 45 to be pivotally mounted with respect to the stationary portion 43 of the housing. In the embodiment shown in FIGS. 4 and 5, the movable portion 45 is mounted to the stationary portion 43 by a pin, shaft, or the like 71 disposed through the aperture 78 in each flange 76, thus allowing the movable portion 45 to pivot about the axis of rotation 49 of the distributor 44.

Figure 7:
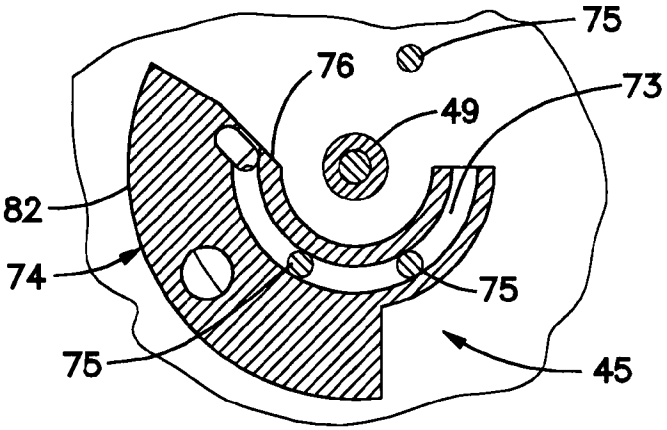
FIG. 7 is a cross-sectional, elevation view of the alternative movable portion, as taken along 7-7 of FIG. 6.
Figure 6:
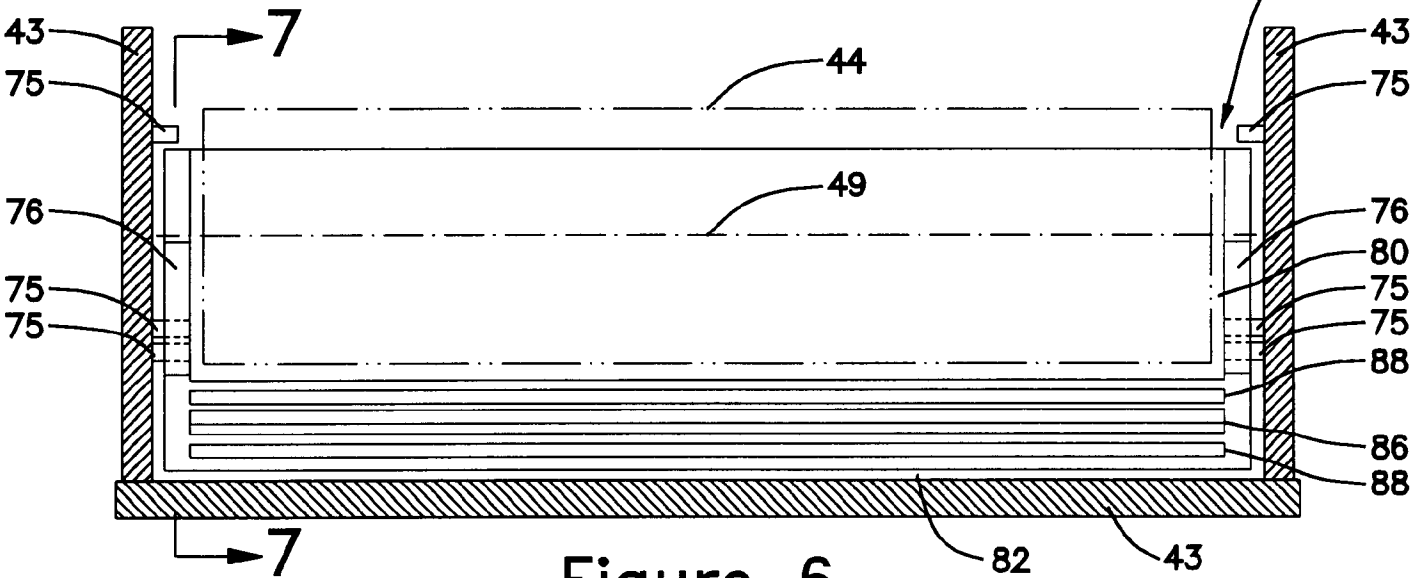
FIG. 6 is an elevation view of an alternative movable portion.

Referring to FIGS. 6 and 7, another method of securing the movable portion 45 relative to fixed portion 43 is shown. In this embodiment, the outboard surfaces of the flange portions 76 include a groove 73 disposed therein. Each groove 73 is generally circular, having the axis of rotation 49 as its center. Received within each groove 73 are cam rollers 75, pins, cams, or the like, which are fixed to the stationary portion 43 of the housing. The cam rollers 75 contact a surface of the groove 73 and support the weight of the movable portion 45. The cam rollers 75 may be secured to the stationary portion 43 by way of adjustable blocks, which allow the movable portion 45 to be adjusted to bring it within close proximity to the distributor 44.

The shape and size of the flange portions 76 and the length of the groove 73 may be selected to facilitate removal of the distributor 44. For example, as shown in FIG. 7, the size and shape of the flange portions 76 and the length of the groove 73 are such that the flange portions 76 do not remain in contact with the lower left hand (with respect to FIG. 7) cam rollers 75 when the movable portion 45 is in the closed position. This allows for the removal of the lower left hand (with respect to FIG. 7) cam rollers 75 to provide sufficient space for the removal of the distributor 44 while the movable portion 45 is in the closed position.

While FIGS. 4-7 provide examples of various methods of mounting the movable portion 45 with respect to the stationary portion 43 of the housing to allow the movable portion 45 to pivot about the axis of rotation 49 of the distributor 44, it is contemplated that any convenient method may be used. For example, the flange portions 76 may be eliminated from the movable portion 45, and the arcuate portion 74 may rest on a lower arcuate surface 79 formed on the stationary portion 43 of the housing 40 (FIG. 2). In this embodiment, the arcuate portion 74 slides along the lower arcuate surface 79 as the movable portion 45 pivots about the axis of rotation 49.

As best seen in FIG. 2, the blades 46 of the distributor 44 and the arcuate inner surface 80 of the movable portion define a space 90 in which the coal 24 is disposed during a portion of a revolution of the rotor 48.

Secured between the stationary and movable portions 43, 45 of the housing 40 are one or more fasteners 92 (e.g., bolts), which secure the position of the movable portion 45 with respect to the stationary portion 43. It will be appreciated that the angular position of the movable portion 45 relative to the distributor 44 affects the throw out location TAH, which in turn affects the trajectory of the coal 24 projected into the combustion chamber 11. Thus, the trajectory of the coal 24 may be adjusted by pivoting the movable portion 45 about the axis 49. The fasteners 45 provide a means for securing the position of the movable portion 45 in a fully open position (shown in FIGS. 2 and 3), a fully closed position (shown in FIGS. 8 and 9), and positions there between. As depicted in FIG. 9, the outer surface 82 of the movable portion 45 may include an array of threaded holes 94, which receive fasteners 92 and allow the angular position of the movable portion 45, and thus the trajectory of the coal 24, to be adjusted. The movable portion 45 may be pivoted between the open and closed positions by way of manual force, or by a motor, hydraulic drive, or the like.

Figure 8:
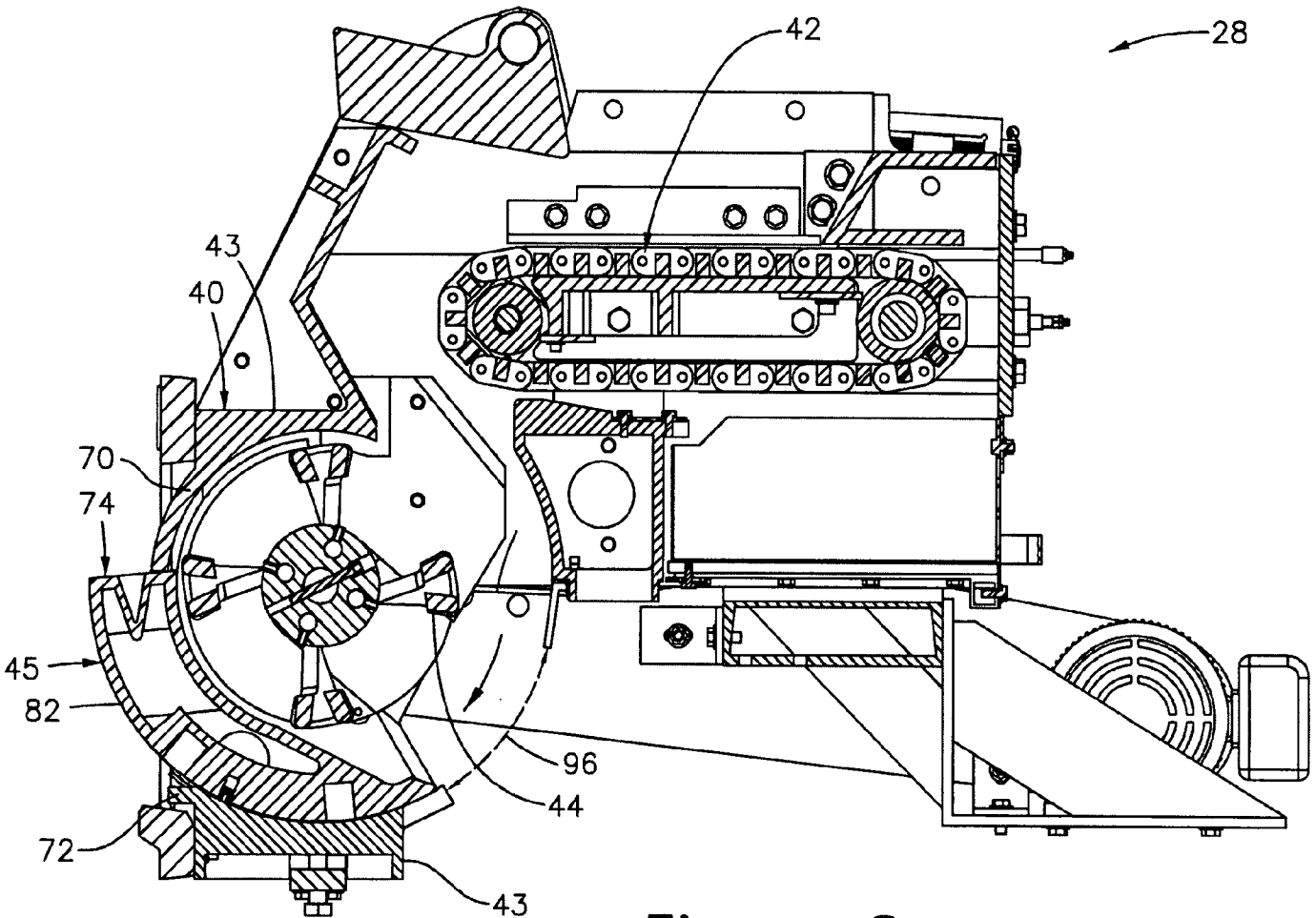
FIG. 8 is a sectional elevation view of the feeder assembly with the frame seal shown in a closed position.
Figure 9:
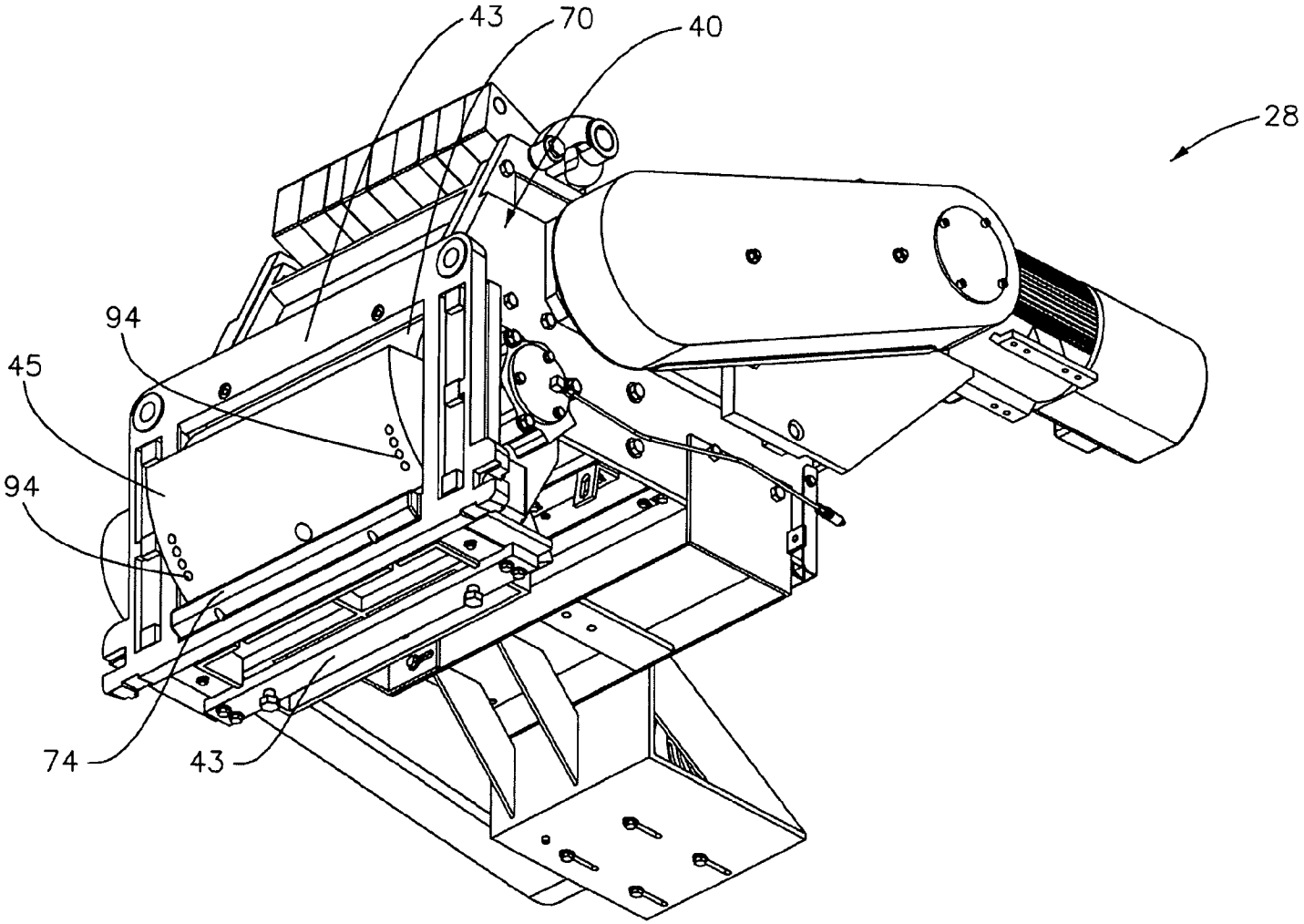
FIG. 9 is a bottom perspective view of the feeder assembly with the frame seal shown in the closed position.

Referring to FIGS. 8 and 9, the feeder assembly is shown with the movable portion 45 in the closed position. In this position, the movable portion 45 closes (substantially obstructs) the aperture 41 (FIG. 2) to shield the distributor 44 from heat emitted from the combustion chamber 11, thus allowing a technician to perform maintenance on the distributor 44 while the furnace 10 is in operation. With the movable portion 45 in the closed position, an end of the arcuate portion 74 abuts the upper frame seal portion 70 of the stationary housing 43, and the lower frame seal portion 72 of the stationary housing 43 is in contact with the outer surface 82 of the movable portion 45, thus closing the aperture 41.

The stationary portion 43 of the housing 40 includes a maintenance access aperture 96, which is exposed by the movable portion 45 when the movable portion is in the closed position shown in FIGS. 8 and 9. The maintenance access aperture 96 allows a service technician to reach the distributor 44. The maintenance access aperture 96 may be sufficiently large to allow the removal of the distributor 44 through the maintenance access aperture 96. Thus, the entire distributor 44 can be repaired and/or replaced without having to shut down the furnace 10. With the movable portion 45 in the open position shown in FIG. 2, the movable portion closes the maintenance access aperture 96.

Since the invention is susceptible to various modifications and alternative forms, it should be understood that the invention is not intended to be limited to the particular forms disclosed. Rather, the scope of the invention extends to all modifications, equivalents and alternatives falling within the spirit and scope of the invention as defined by the appended claims.

What is claimed is:

1. An apparatus for projecting solid fuel into a combustion chamber of a furnace, the apparatus comprising:

a rotor having blades extending outwardly therefrom, the rotor being rotatable to project the solid fuel into the combustion chamber; and a housing having:

a maintenance access aperture allowing access to the rotor for maintenance;

a fuel aperture through which the solid fuel is projected from the rotor into the combustion chamber, the housing including a movable portion between the rotor and the combustion chamber adapted to move between:

a first position wherein the fuel aperture is fully open to allow the solid fuel to be projected into the combustion chamber and the maintenance access aperture is closed, and a second position wherein the movable portion completely closes the fuel aperture to shield the rotor from heat emitted from the combustion chamber and opens the maintenance access aperture.

2. The apparatus of claim 1, wherein the movable portion pivots about an axis of rotation of the rotor.

3. The apparatus of claim 1, wherein the movable portion has an air duct disposed therein, the air duct being configured to direct a stream of air towards the combustion chamber for assisting the rotor in projecting the solid fuel into the combustion chamber.

4. The apparatus of claim 1, wherein the blades of the rotor and an arcuate surface of the movable portion define a space in which the solid fuel is disposed during a portion of a revolution of the rotor.

5. The apparatus of claim 4, wherein the movable portion pivots about an axis of rotation of the rotor, and wherein pivoting the movable portion about the axis adjusts a trajectory of the solid fuel projected from the rotor into the combustion chamber.

6. The apparatus of claim 4, wherein the maintenance access aperture is adapted to open wide enough to service the rotor when the movable portion is in the second position, and the maintenance access aperture being closed by the movable portion when the movable portion is in the first position.

7. The apparatus of claim 1, wherein the blades of the rotor and an arcuate surface of the movable portion define a space in which the solid fuel is disposed during a portion of a revolution of the rotor, the movable portion pivots about an axis of rotation of the rotor, and the movable portion has an air duct disposed therein, the air duct being configured to direct a stream of air towards the combustion chamber for assisting the rotor in projecting the solid fuel into the combustion chamber.

8. The apparatus of claim 7, wherein pivoting the movable portion about the axis adjusts a trajectory of the solid fuel projected from the rotor into the combustion chamber.

9. The apparatus of claim 8, wherein the housing further includes a maintenance access aperture disposed therein, the maintenance access aperture being open when the movable portion is in the second position, and the maintenance access aperture being closed by the movable portion when the movable portion is in the first position.

10. The apparatus of claim 1, wherein the movable portion has an air duct disposed therein, and when the moveable portion is in the second position, the air duct acts to thermally insulate the combustion chamber from the rotor, reducing a temperature of the rotor, thereby allowing maintenance of the rotor at the reduced temperature.

11. A feeder assembly for projecting solid fuel into a combustion chamber of a furnace, the feeder assembly comprising:

a housing having an aperture disposed therein through which the solid fuel is projected into the combustion chamber;

a distributor disposed in the housing, the distributor including a rotor having blades extending outwardly therefrom, the rotor being rotatable to project the solid fuel into the combustion chamber;

a feeder disposed in the housing, the feeder including a conveyor assembly for providing the solid fuel to the rotor; and wherein the housing includes a movable portion movable between:

a first position wherein the aperture is open to allow the solid fuel to be projected into the combustion chamber, and a second position wherein the movable portion completely closes the aperture to shield the rotor from heat emitted from the combustion chamber.

12. The feeder assembly of claim 11, wherein the movable portion pivots about an axis of rotation of the rotor.

13. The feeder assembly of claim 11, wherein the movable portion has an air duct disposed therein, the air duct being configured to direct a stream of air towards the combustion chamber for assisting the rotor in projecting the solid fuel into the combustion chamber.

14. The feeder assembly of claim 11, wherein the blades of the rotor and an arcuate surface of the movable portion define a space in which the solid fuel is disposed during a portion of a revolution of the rotor.

15. The feeder assembly of claim 14, wherein the movable portion pivots about an axis of rotation of the rotor, and wherein pivoting the movable portion about the axis adjusts a trajectory of the solid fuel projected from the rotor into the combustion chamber.

16. The feeder assembly of claim 14, wherein the housing further includes a maintenance access aperture disposed therein, the maintenance access aperture being open wide enough to service the rotor when the movable portion is in the second position, and the maintenance access aperture being closed by the movable portion when the movable portion is in the first position.

17. The feeder assembly of claim 11, wherein the blades of the rotor and an arcuate surface of the movable portion define a space in which the solid fuel is disposed during a portion of a revolution of the rotor, the movable portion pivots about an axis of rotation of the rotor, and the movable portion has an air duct disposed therein, the air duct being configured to direct a stream of air towards the combustion chamber for assisting the rotor in projecting the solid fuel into the combustion chamber.

18. The feeder assembly of claim 17, wherein pivoting the movable portion about the axis adjusts a trajectory of the solid fuel projected from the rotor into the combustion chamber.

19. The feeder assembly of claim 18, wherein the housing further includes a maintenance access aperture disposed therein, the maintenance access aperture being open when the movable portion is in the second position, and the maintenance access aperture being closed by the movable portion when the movable portion is in the first position.

20. A method of shielding a distributor rotor from heat emitted from a combustion chamber in a furnace, the method comprising:

pivoting a movable portion of a rotor housing about a rotational axis of the rotor from a first position to a second position, wherein, in the first position, an aperture in the rotor housing is open to allow the rotor to project solid fuel into the combustion chamber, and in the second position, the movable portion completely closes the aperture to shield the rotor from the heat emitted from the combustion chamber and opens a maintenance access aperture wide enough to service the rotor.

21. The method of claim 20, wherein the movable portion has an air duct disposed therein, the air duct being configured to direct a stream of air towards the combustion chamber for assisting the rotor in projecting the solid fuel into the combustion chamber.

* * * * *